United States Patent [19]

Shnitkin et al.

[11] Patent Number: 4,638,323

[45] Date of Patent: Jan. 20, 1987

[54] ASYMMETRIC RIDGE WAVEGUIDE COLLINEAR SLOT ARRAY ANTENNA

[75] Inventors: Harold Shnitkin, Roslyn, N.Y.; Julius Green, Trumbull, Conn.

[73] Assignee: United Technologies Corporation, Hartford, Conn.

[21] Appl. No.: 727,316

[22] Filed: Apr. 25, 1985

[51] Int. Cl.[4] ..... H01Q 13/12

[52] U.S. Cl. ..... 343/771

[58] Field of Search ..... 343/767, 768, 770, 771

[56] References Cited

U.S. PATENT DOCUMENTS 3,189,908 6/1965 Provencher ..... 343/771

OTHER PUBLICATIONS

H. Gruenbert, "Second-Order Beams of Slotted Waveguide Arrays", Canadian Journal of Physics, vol. 31, pp. 55-69, Jan. 1953.

S. Silver, "Microwave Antenna Theory and Design", McGraw-Hill Book Co., New York, N.Y., Ch. 9, Section 9:19, p. 318 (1949).

L. A. Kurtz & J. S. Yee, "Second-Order Beams of Two Dimensional Slot Arrays", IRE Transaction on On Antennas and Propagation, pp. 356-362, Oct. 1957.

S. B. Cohn, "Properties of Ridge Wave Guide", Proceeding of the I.R.E., pp. 783-788, Aug. 1947.

J. R. Pyle, "The Cutoff Wavelength of the $TE_{10}$ Mode in Ridged Rectangular Waveguide of Any Aspect Ratio", IEEE Transaction on Microwave Theory and Techniques, vol. MTT 14, No. 4, pp. 175-183, Apr. 1966.

Samuel Hopfer, "The Design of Ridged Waveguides", IRE Transaction-Microwave Theory and Techniques, pp. 20-29, Oct.

*Primary Examiner*—Eli Lieberman

*Attorney, Agent, or Firm*—Robert P. Sabath

[57] ABSTRACT

In a slotted array antenna (12), an asymmetric ridge waveguide element (13) defining colliner radiating slots (16), said waveguide elements (13) defining a central hollow region (13') and an axial ridge (13'') separating first and second series of side chambers (17' and 17'') alternating in height with respect to each other, whereby production of second order beams of radiation from said antenna (12) is eliminated and much lower side lobe levels are produced when the element (13) is used in an array scanned in a plane perpendicular to the element axes.

5 Claims, 5 Drawing Figures

ASYMMETRIC RIDGE WAVEGUIDE COLLINEAR SLOT ARRAY ANTENNA

The Government has rights in this invention pursuant to Contract No. DAAK20-83-C-0892 awarded by the Department of the Army.

DESCRIPTION

1. Technical Field

This invention relates to the technology of radar systems and more particularly to the technical field of radar antenna design.

2. Background Art

Slotted waveguide array antennas of the past have employed a quasi-rectilinear grid of parallel oriented slots cut into the broadwall of rectangular waveguides.

This well-known arrangement is often referred to as a planar shunt slot array. In such shunt slot arrays, the slots are excited by transverse wall currents or longitudinal magnetic fields at the interior waveguide wall.

Both the magnitude and phase of electromagnetic radiation produced by such slots is controlled by slot location in the waveguide broadwall. In particular, displacement from the centerline determines the magnitude of radiation from a particular slot. Slots located along the actual waveguide centerline do not radiate at all.

Further, the axial position of each slot with respect to the axial position of the remaining slots determines the relative phase of the radiation from that slot.

In particular, the magnitude of the radiated field varies sinusoidally with slot displacement from the centerline, according to the following relationship:

$$V_R = K \sin[D(pi)/a],$$

where

"$V_R$" is the radiated voltage level;

"K" is a constant depending upon the frequency and dimensions of the waveguide;

"D" is the distance of the slot centerline from the waveguide centerline;

"pi" is the number "pi", i.e. 3.14 etc.; and

"a" is the interior width of the waveguide.

This relationship illustrates that a 180° phase shift can be obtained by relocating a slot from one side of the centerline (positive value of D) to the opposite side (negative value of D). Since the interior waveguide fields change phase linearly along the waveguide axis at a rate of 360° per waveguide wavelength, equal phase radiation for all radiating slots can be achieved by spacing slots a half waveguide wavelength apart and alternating the slot offset from the waveguide centerline. Thus, only alternate slots in the array are approximately collinear. In such an arrangement, the result is a radiation beam normal or perpendicular to the slotted array planar surface.

The spacing between slots in a rectilinear slot array according to the prior art cannot exceed certain known limits, if only a single radiating beam is desired. Such a single beam is typically required in direction finding antennas, military radar antennas subject to jamming and antennas located near the earth's surface or near large objects which might scatter a potential second beam in the direction of the main beam.

Secondary beams or "grating lobes" occur in any direction in which the combination of slot excitation phase and phase delay due to unequal distances from the slot to the observer causes the observed phases from all the slots in the antenna array to be equal, or different by an integral multiple of 360°.

The slot spacing criterion for the avoidance of such secondary beams of a planar antenna array can be expressed according to the following relationship:

$$Smax < (lambda_0)/(1 + \sin[theta])$$

where

Smax is the maximum slot spacing permitted;

"$lambda_0$" is the free space wavelength; and

"theta" is the angular direction of the antenna main beam measured from a vector normal to the array plane.

Thus, for a normal beam direction, a one-wavelength spacing, and for a 90° beam from the normal, a half-wavelength spacing may not be exceeded.

Considerations of slot spacing are of considerable importance in electrically steered antenna arrays. More particularly, for planar arrays consisting of a set of linear broadwall slot waveguide arrays which are to be electronically scanned in a plane perpendicular to the waveguide lengths, the rectangular, airfilled waveguide normally employed must be replaced by either a dielectrically filled waveguide, or as is often preferably done, an airfilled ridge waveguide, to satisfy the slot spacing criterion.

In both cases however, slot positioning is similar to that in conventional waveguides. In other words, alternate slots are on opposite sides of the waveguide centerline.

The alternation of successive slots necessary for coupling causes the radiated fields to fail to cancel properly at certain space direction, resulting in the appearance of undesired secondary beams.

Secondary beams due to a staggered slot configuration are disadvantageous for many applications, in particular those requiring low levels of radiated side lobes.

In general, shunt slots parallel to the waveguide axis need to be displaced on alternate sides of the centerline in order to radiate as discussed previously. The radiation pattern of a two-dimensional array is described by the prior art by the product of an array factor and an element factor. These factors respectively express the sum of the contributions from each of the elements to the field in a given space direction and the directive characteristics of a typical repetitive elemental radiator. The array factor accounts for the relative element excitation amplitude and phase as well as the positions of the elements in the array, and the element factor describes the radiation from a single element.

For purposes of radiation pattern calculations, the slots in an array are usually assumed to be identical and precisely collinear. This assumption cannot be made, however, if second order beams are to be taken into account. Instead, it becomes necessary to arrange the slots into identical repetitive groups containing the smallest possible number of slot elements; the radiation pattern of each slot group then becomes the element factor for the array. Slots within an element group, however, are treated as having equal amounts of displacement from the waveguide center and therefore equal amplitudes of excitation.

Since there are typically at least two slots in each group, the separation between identical element groups has increased beyond the limits dictated by the equation for maximum slot spacing "Smax" above. This results in the generation of secondary beams, when the array is electronically scanned, frequently at levels higher than the maximum tolerable side lobe level. These secondary beam levels are equal to the magnitude of element factor of the slot group in the spacial direction for which the array factor equals unity, because all element contributions differ in phase by an integer multiple of 360 degrees.

For more detailed information regarding the above, see H. Gruenberg, "Second-Order Beams of Slotted Waveguide Arrays," Canadian Journal of Physics, Vol. 31, pp. 55–69 (January 1953); S. Silver, "Microwave Antenna Theory and Design," McGraw-Hill Book Co., Inc., New York, N.Y., Ch. 9, Section 9:19, p. 318 (1949); and "Second-Order Beams of Two Dimensional Slot Arrays", L. A. Kurtz & J. S. Yee, (October 1957) IRE Transactions on Antennas and Propagation, pp. 356–362.

SUMMARY OF THE INVENTION

According to the invention herein, waveguide elements in a slotted array antenna comprise an axial ridge of constant height straddled by first and second pluralities of alternating side chambers, alternating between high and low levels every half waveguide wavelength, thereby causing an asymmetry in the waveguide longitudinal magnetic field vector. The chambers on opposite sides of the axial ridge being, 180 degrees out of phase with respect to one another in order to maintain in-phase radiation of adjacent slots. In other words, radiating slots, each on the centerline of said waveguide element array and axially synchronous with the alternating high and low chamber levels, experience equiphase excitation because of the combination of alternating chamber asymmetry and 180° waveguide phase delay in the waveguide between adjacent slots.

BRIEF DESCRITION OF THE DRAWING

DETAILED DESCRIPTION OF A PREFERRED EMBODIMENT

Figure 1:
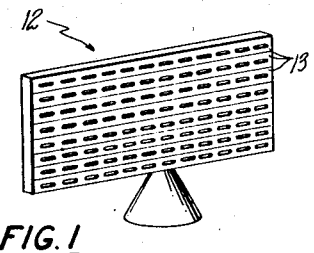
FIG. 1 is a front view of a typical flat plate slotted array radar antenna including a plurality of parallel waveguides defining collinear slots.

FIG. 1 schematically shows a slotted array antenna 12 for transmission and reception of radar signals. The antenna 12 is constructed of a plurality of waveguide elements 13 mounted together in parallel as an array structure with a microwave feed arrangement (not shown) behind the array for receiving and transmitting.

According to the invention herein, each waveguide 13 defines axial collinear shunt radiating slots 16 in a radiating surface (the broadwall of ridge waveguide) thereof. Slots 16 are shunt slots in that they are parallel to the axis of waveguide element 13. These slots 16 are arranged in accordance with the invention along a single line on the radiating surface of each waveguide element 13, to eliminate secondary beams generated by non-collinear slotted arrays.

Figure 2A:
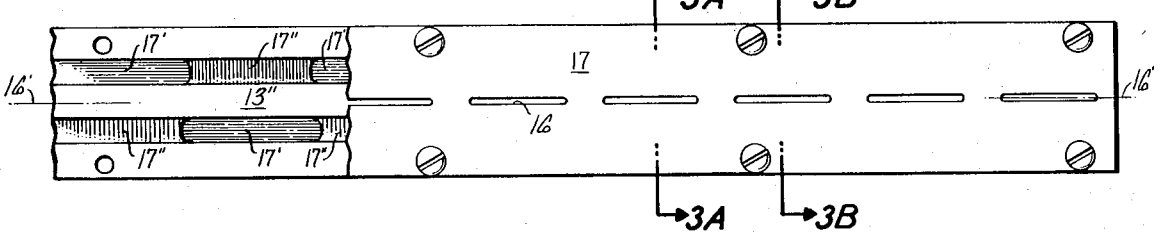
FIG. 2A is a front view of a single ridge waveguide with collinear slots.

FIG. 2A shows a portion of a single one of these waveguides 13 as viewed from the radiating side. In particular, FIG. 2A indicates the radiating surface of waveguide 13 in a manner expressing explicitly the linear arrangement of the radiating slots 16 defined therein along the common centerline 16'.

As can be seen, according to the invention, these slots 16 are elongated, and measure approximately one half wavelength in length. Other kinds of apertures, as is well known in the art, can be substituted.

The spacing between adjacent slots 16 establishes a half waveguide wavelength as defined by the wave velocity in the waveguide 13 itself.

The lower or base portion of each such waveguide 13 is, for example, machined from a long bar of aluminum, to define a hollow center space 13' including alternating high and low side chambers respectively 17' and 17''.

A thin plate 17, which is considered to be part of waveguide element 13, is suitably attached over the hollow center space 13', as by brazing for example. The slots 16 in plate 17 are in turn suitably machined or punched in this plate 17 before assembly. Plate 17 is shown covering only a single waveguide element 13, but could cover the entire radiating face of slotted array antenna 12.

Figure 2B:
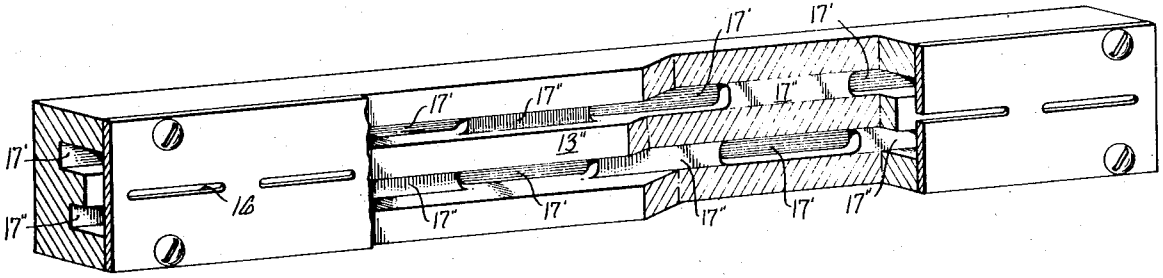
FIG. 2B is an isometric view of a single ridge waveguide broken open to show the alternating high and low side chambers of the waveguide.

FIG. 2B shows in isometric view the alternating high and low side chambers 17' and 17'', which alternate axially in each waveguide at half waveguide wavelength intervals, to compensate for the 180° phase delay between adjacent slots, as dictated by the half waveguide wavelength separation required by this design. When one side chamber is low, its corresponding side chamber on the opposite side of the waveguide is high, according to the invention.

Figure 3A:
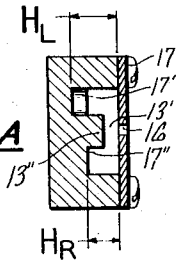
FIG. 3A and 3B are respective cross-sections of the waveguide of FIG. 2 at adjacent slots.
Figure 3B:
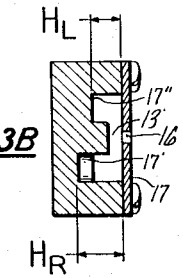

FIGS. 3A and 3B show cross-sections of the waveguide 13 at adjacent eloncated slots 16. These figures effectively emphasize the difference in height between adjacent side chambers. As can be seen, the waveguide 13 defines a central ridge 13' of constant elevation. This ridge is straddled by opposite pluralities of side chambers 17' and 17'' of variable height.

In particular, respective right and left side chambers 17' and 17'' have respective heights $H_R$ and $H_L$ which displace the electrical and magnetic axis of symmetry of waveguide 13 away from the mechanical axis of symmetry or centerline 16' as well as slot 16 located thereon to maintain the desired phase and amplitude relationship already suggested above. This arrangement permits a longitudinal magnetic field to be established along the centerline, which produces electromagnetic radiation through each centrally located slot 16.

The amplitude of electromagnetic radiation from each slot 16 is controlled by the amount of side chamber asymmetry and the resulting displacement distance of the electrical axis of symmetry from the mechanical axis of symmetry. The electrical axis of symmetry is here defined as the plane in which the value of the resultant longitudinal magnetic field vector is zero. Utilizing the equation of radiated voltage level "$V_R$" already indicated in the background section above, where "a" now represents the ½ cut-off wavelength of ridge waveguide and "D" the displacement distance of the electrical axis of symmetry from the mechanical axis of symmetry, the radiated voltage level $V_R$ can be calculated.

A 180° excitation phase change in radiated output contribution is caused by adjacent slot spacing at half guide wavelengths. This is accomplished by alternating the $H_R$ and $H_L$ dimensions of adjacent axial side chambers which correspond to adjacent slots. This results in the establishment of a so-called equiphase antenna array.

The design of a waveguide slot antenna array according to the invention herein requires first calculating the wavelength in the waveguide, i.e. (lambda)g, and second the slot coupling to the waveguide.

The first factor determines the phase relationships of the energy radiated from the various slots, as a function of their physical spacing. In other words, by knowing the wavelength of energy present within a waveguide 13, it is possible to determine the spacing between adjacent slots 16 and side chambers 17' and 17''.

The second factor determines the magnitude of the power radiated from each slot, which determines the overall antenna energy distribution.

Together these two factors determine the operating characteristics of antenna 12 comprising waveguide elements 13.

By selecting a symmetrically tapered energy distribution, and selecting the same wavelength throughout the waveguide, a low sidelobe, equi-spaced slot array, free from secondary beams, can be produced.

Methods for calculating the velocity of energy propagation and the degree of slot coupling follow.

In particular, the guide velocity of propagation "$C_g$" is equal to the guide wavelength times the selected frequency of radiation. The waveguide wavelength (lambda)g at this frequency is determined from the relationship $$(\text{lambda})g^2 = \frac{[(\text{lambda})c]^2[(\text{lambda})o]^2}{[(\text{lambda})c]^2 - [(\text{lambda})o]^2}$$

where (lambda)c is the cut-off wavelength of the waveguide; and (lambda)o is the free space wavelength of the design frequency of antenna 12.

In order to determine the cut-off wavelength for an asymmetric waveguide, one must refer to the previously established technique for determing the cut off frequency in a symmetric ridge waveguide. This can be determined by calculating the frequency at which the input impedance $Z_i$ to the waveguide 13 is infinite for the transverse parallel plate TEM mode. See for example S.B. Cohn; Proceedings of the Institute of Radio Engineers, August 1947, pp. 783–788.

According to the invention herein, the cut-off frequency for the asymmetric waveguide is determined differently. The input impedance is determined for each side of the waveguide 13, and the cut-off frequency is the frequency at which the input impedance for one side is the complex conjugate of the input impedance of the other side of the waveguide 13. See J. R. Pyle, IEEE-T-MTT, April 1966, Vol. MTT-14, No. 8, pp. 175–183 for additional detail.

By way of an example, the side chamber width is about 0.168 inches; the central ridge is 0.224 inches wide and the separation between the top of the central ridge and the plate 17 is about 0.102 inches. The degree of asymmetry in the heights of the side chambers of course determines the amount of slot radiation. The following table shows examples of heights of adjacent side chambers 17' and 17'' as a function of normalized slot conductance all possessing equal waveguide wavelength used in the design of an equi-spaced array with tapered array illumination.

TABLE I

| 17' | 17'' |
|---|---|
| .252 | .252 |
| .220 | .300 |
| .238 | .275 |
| .183 | .350 |
| .150 | .400 |

By way of further detail, the slot coupling from waveguide 13 can be expressed in terms of the equivalent slot conductance "g" in shunt across the waveguide 13. For a symmetric waveguide, where coupling occurs because of sideward slot displacement from the electrical and physical waveguide centerline, the degree of slot coupling, which can be represented in terms of the slot conductance "g" follows the relationship indicated:

$$g = K_1 \sin^2(K_2 D)$$

where the constants, $K_1$ and $K_2$, are determined by the particular geometry of the waveguide 13 employed. These constants are usually determined experimentally by measuring slot conductances for several values of displacement "D".

According to the present invention, the slots 16 are located directly on the physical centerline 16' but the effective electrical centerline is displaced from the physical centerline 16' because of the waveguide asymmetry. The location of the electrical centerline is not shown in the drawing but is in fact determinable by a computation similar to that used for the computation of the cut-off frequency.

In particular, the location of the electrical centerline is on the plane in which the longitudinal magnetic field inside the waveguide vanishes.

Then to determine slot radiation, the formulas for slot coupling already indicated, $g = K^1 \sin^2(K_2 D)$, is employed, where "D" is the displacement distance of the electrical centerline from the mechanical centerline.

Fabrication of an asymmetrical ridge waveguide according to the invention herein is inexpensive, because only the waveguide side-chamber height dimensions are required to vary periodically, while all other surfaces remain parallel to the waveguide axis.

As suggested above, the operation of the asymmetric ridge waveguide slot array merely depends upon displacement of the electrical axis of symmetry of the waveguide from the midpoint between the waveguide sidewalls. This establishes a non-zero longitudinal magnetic field inside the guide 13 just below the radiating slot 16, and thus permits the waveguide to radiate at a predetermined signal level.

One skilled in the art is likely to be led by the description above to conceive of variations of the invention which nonetheless fall within the scope thereof. Accordingly, attention is directed toward the claims which follow, as they specify the metes and bounds of the invention with particularity.

I claim:

1. A slotted array antenna, comprising a plurality of waveguide elements each comprising opposite radiating and non-radiating sides, wherein said waveguide elements are characterized in that said radiating side defining a series of radiating slots along a centerline thereof, in that said non-radiating side includes an axial ridge of constant height directed toward said radiating slots, and in that each of said waveguide elements defines first and second pluralities of alternating side chambers on opposite sides of said axial ridge, said alternating side chambers alternating between predetermined high and low levels, whereby secondary radar beams are eliminated.

2. The array antenna of claim 1, further charaterized in that each of said waveguide elements defines a hollow central space along said central ridge in electromagnetic coupling with said radiating slots.

3. The array antenna of claim 1, further characterized in that each of said pair of side chambers is associated with an adjacent one of said radiating slots.

4. The array antenna of claim 1, further characterized in that the alternating depth of the side chamber on one side of said central ridge is substantially 180 degrees out of phase with the alternating depth of the side chamber on the other side of said axial ridge.

5. In a slotted array antenna, a slotted hollow waveguide element comprising opposite radiating and non-radiating sides; wherein said waveguide element is characterized in that said radiating side defines a series of radiating slots arranged along a centerline thereof, in that said non-radiating side includes an axial ridge of constant height directed toward said radiating slots, and in that said waveguide element defines first and second pluralities of alternating depth of side chambers on opposite sides of said axial ridge, said alternating side chambers alternating between high and low levels, at a period coinciding with the spacing of said radiating slots.

* * * * *